US006146193A

United States Patent [19]

Yu

[11] Patent Number: 6,146,193

[45] Date of Patent: Nov. 14, 2000

[54] ENGAGING MEANS FOR STACKED CARD CONNECTORS

[75] Inventor: Hung-Chi Yu, Hsi-Chih, Taiwan

[73] Assignee: Hon Hai Precision Ind. Co., Ltd., Taipei Hsien, Taiwan

[21] Appl. No.: 09/330,911

[22] Filed: Jun. 11, 1999

[30] Foreign Application Priority Data

Dec. 28, 1998 [TW] Taiwan ..... 87221644

[51] Int. Cl.[7] ..... H01R 13/635

[52] U.S. Cl. ..... 439/541.5; 439/607

[58] Field of Search ..... 439/541.5, 570, 439/64, 377, 540.1, 607, 609, 160

[56] References Cited

U.S. PATENT DOCUMENTS

| | | | |
|---|---|---|---|
| 5,496,195 | 3/1996 | Reed | 439/607 |
| 5,591,047 | 1/1997 | Yamada et al. | 439/541.5 |
| 5,643,001 | 7/1997 | Kaufman et al. | 439/159 |
| 5,967,845 | 10/1999 | Ho et al. | 439/607 |
| 6,071,149 | 6/2000 | Hara | 439/607 |

*Primary Examiner*—Brian Sircus
*Assistant Examiner*—Son V. Nguyen
*Attorney, Agent, or Firm*—Wei Te Chung

[57] ABSTRACT

A stacked card connector assembly comprises a shielding including upper and lower shields attached together, a pair of headers positioned in the housing with a number of contacts received therein, and a pair of card ejection mechanisms mounted to a side extension of the housing. Engaging mechanism and mating mechanism for mating with the engaging mechanism are integrally formed on opposite side extensions of the upper and lower shields, respectively. The engaging mechanism of the upper shield comprises a latch hook formed on one side extension, and a tenon and a tab formed on the other side extension. The mating mechanism of the lower shield comprises a latch tab on one side corresponding to the latch hook of the upper shield, and an inserting piece on the other side corresponding to the tenon and tab of the upper shield with an aperture disposed therein for engaging with the tab. The inserting piece further comprises a pair of stop portions extending from opposite sides thereof for abutting against the corresponding tenon.

2 Claims, 8 Drawing Sheets

ENGAGING MEANS FOR STACKED CARD CONNECTORS

BACKGROUND OF THE INVENTION

The present invention relates to stacked card connectors, and particularly to engaging means of stacked card connectors for facilitating assembly thereof.

1. Description of Prior Art

As the popularity of notebook computers increases, electrical card connectors are becoming more common for coupling a diskette or an IC (integral circuit) card to the computer for storing or receiving data contained on the diskette or IC card. Most current IC cards and electrical card connectors conform to the standards of PCMCIA (Personal Computer Memory Card Industry Association).

It is desirable to have several PCMCIA cards accessible to the computer to meet the demand for an increase in data storage capacity of personal computers. To this end, card connectors are commonly stacked and then mounted to a printed circuit board (PCB) thereby conserving space. Currently, PCMCIA card connectors are stacked in pairs and are known as stacked card connectors which are formed by vertically attaching two single connectors together.

Various engaging means, such as screw sets and movable fasteners, are applied to fasten the two single connectors together. Taiwan Pat. Application No. 86210606 and U.S. Pat. No. 5,591,047 disclose pertinent designs. Referring to FIG. 1, a conventional stacked card connector assembly 4 including two connectors is fastened by means of a screw set including a bolt 44 and a nut 45. A shield 40 is attached to the card connector 4 by a pair of positioning pieces 41 extending from opposite sides thereof. Each positioning piece 41 has an aperture 411 disposed therein. A pair of guide frames 43 extends from a header 42 of each single connector (not labeled). A hole 431 is disposed in each guide frame 43 for the extension of the bolt 44 therethrough.

In assembly, the shield 40 is placed on the guide frame 43, and the positioning piece 41 is aligned with the hole 431 and the nut 45 on one side of the shield 40. The bolt 44 is inserted into the hole 431 from an opposite side of the shield 40 whereby one hand is required to stabilize the nut 45 while the other hand rotates the bolt 44 for fastening the components together. While engaging the nut 45 with the bolt 44, the positioning piece 41 is planar and can not prevent the nut 45 from vertical movement, thus the nut 45 may be displaced by the bolt 44 during assembly. Therefore, one hand must hold the nut 45 while the other hand rotates the bolt 44, which is inconvenient and time inefficient.

Movable fasteners are also used to fasten two single connectors together as disclosed in U.S. Pat. No. 5,591,047. However, this approach increases the number of components and complicates the manufacturing process, which is unfavorable for decreasing manufacturing costs and increasing manufacturing efficiency.

The present invention is directed at solving the problems identified above and providing an integrally formed engaging means for stacked card connectors.

SUMMARY OF THE INVENTION

Accordingly, one object of the present invention is to provide improved two stacked card connectors for simplifying and expediting assembly.

Another object of the present invention is to provide engaging means integrally formed on the stacked card connectors for decreasing manufacturing costs and increasing manufacturing efficiency.

In order to achieve the objects set forth, a stacked card connector assembly consisting of two connectors in accordance with a preferred embodiment of the present invention comprises a shielding including upper and lower shields attached together, a pair of headers positioned in the housing with a plurality of contacts received therein, and a pair of card ejection mechanisms mounted to a side extension of the shielding. Engaging means and mating means mating with the engaging means are integrally formed on opposite side extensions of the upper and lower shields, respectively. The engaging means of the upper shield comprises a latch hook formed on one side extension, and a tenon and a tab formed on the other side extension. The mating means of the lower shield comprises a latch tab on one side extension corresponding to the latch hook of the upper shield, and an inserting piece on the other side extension corresponding to the// tenon and tab of the upper shield with an aperture disposed therein for engaging with the tab. The inserting piece further comprises a pair of stop portions extending from opposite sides thereof for abutting against the corresponding tenon.

When engaging the shields with each other, the latch hook on one side of the upper shield is first hingedly engaged with the corresponding latch tab of the lower shield. The lower shield is then rotated toward the upper shield for engaging the inserting piece on the other side of the lower shield with the corresponding tenon of the upper shield whereby the aperture of the inserting piece engages with the corresponding tab and the stop portion abuts against the tenon. Thus, the upper and lower shields are retentively engaged with each other.

Alternatively, the engaging means of the upper shield comprises a tenon and a tab formed on both of the opposite side extensions. The mating means of the lower shield thereby comprises an inserting piece on opposite side extensions corresponding to the tenon and tab of the upper shield with an aperture disposed therein for engaging with the tab. In such a case, the upper and lower shields are engaged with each other without a rotational action.

Other objects, advantages and novel features of the invention will become more apparent from the following detailed description when taken in conjunction with the accompanying drawings.

DETAILED DESCRIPTION OF PREFERRED EMBODIMENT

Figure 1:
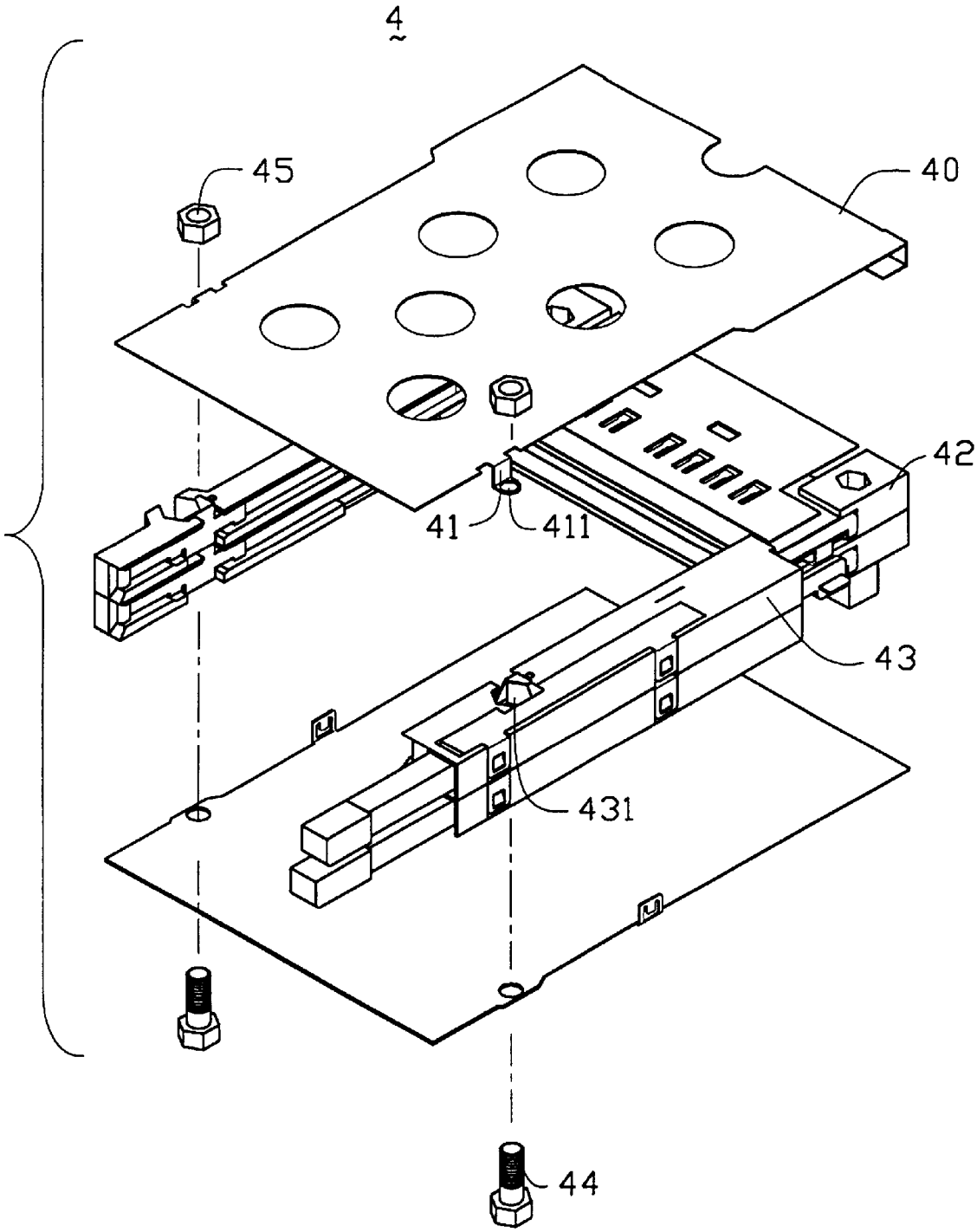
FIG. 1 (PRIOR ART)
FIG. 1 is a partially exploded view of a conventional stacked card connector assembly assembly.
Figure 2:
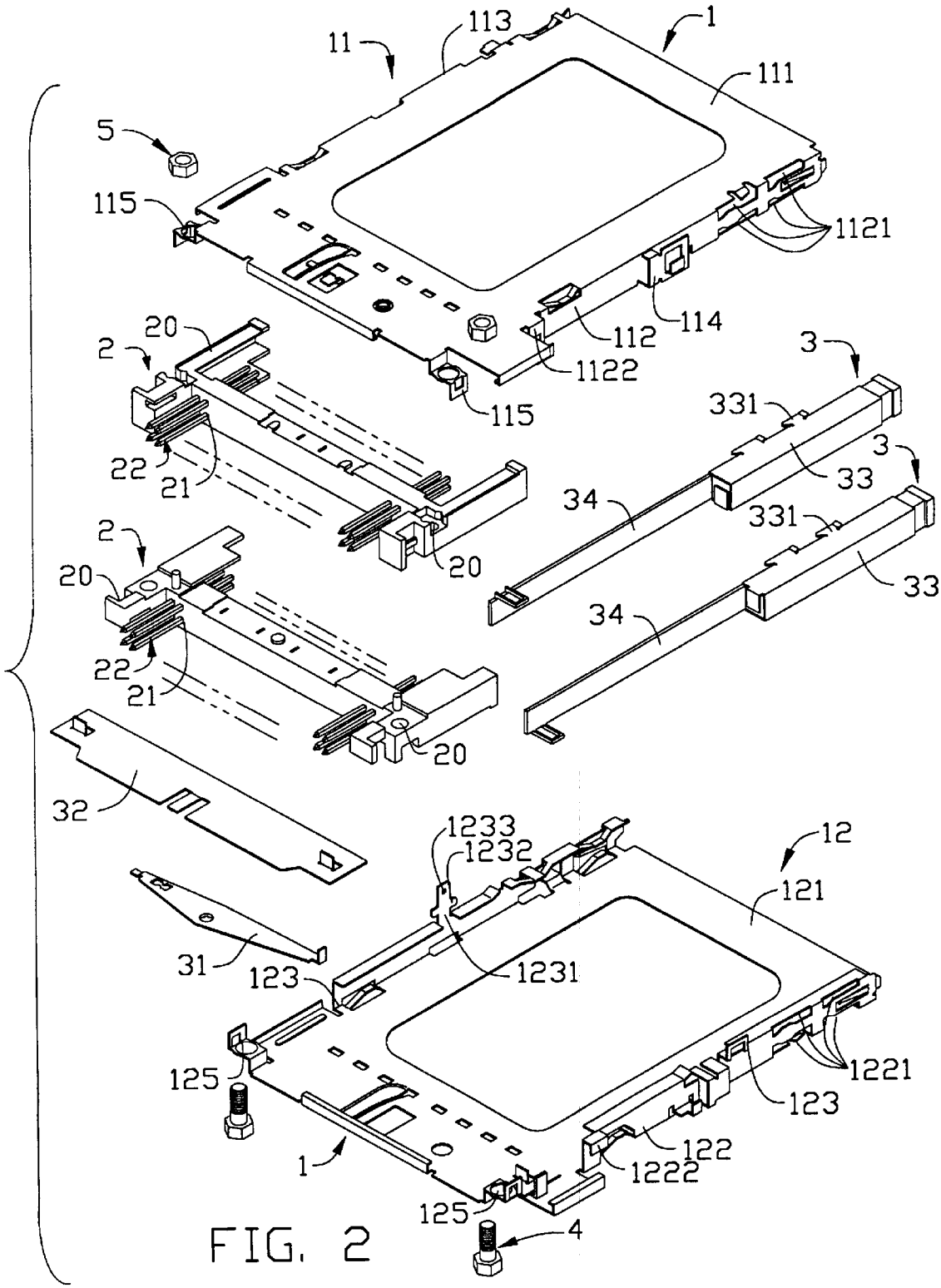
FIG. 2 is an exploded view of a stacked card connector assembly in accordance with a preferred embodiment of the present invention.

Referring to FIG. 2, a stacked card connector assembly in accordance with a preferred embodiment of the present invention comprises a shielding 1 having upper and lower shields 11, 12 attached together, a pair of headers 2 positioned in the housing 1, and a pair of card ejection mechanisms 3 mounted to a side extension of the housing 1. The upper shield 11 comprises a top surface 111 with opposite side extensions 112, 113 extending therefrom, and the lower shield 12 comprises a bottom surface 121 with opposite side extensions 122, 123 extending therefrom. Engaging means including first and second engaging means is integrally formed on middle portions of opposite side extensions 112, 113 of the upper shield 11. Mating means including first and second mating means for mating with the engaging means is integrally formed on middle portions of opposite side extensions 122, 123 of the lower shield 12. Alternatively, the first engaging and mating means are respectively identical to the second engaging and mating means, which serves the same function.

Figure 4A:
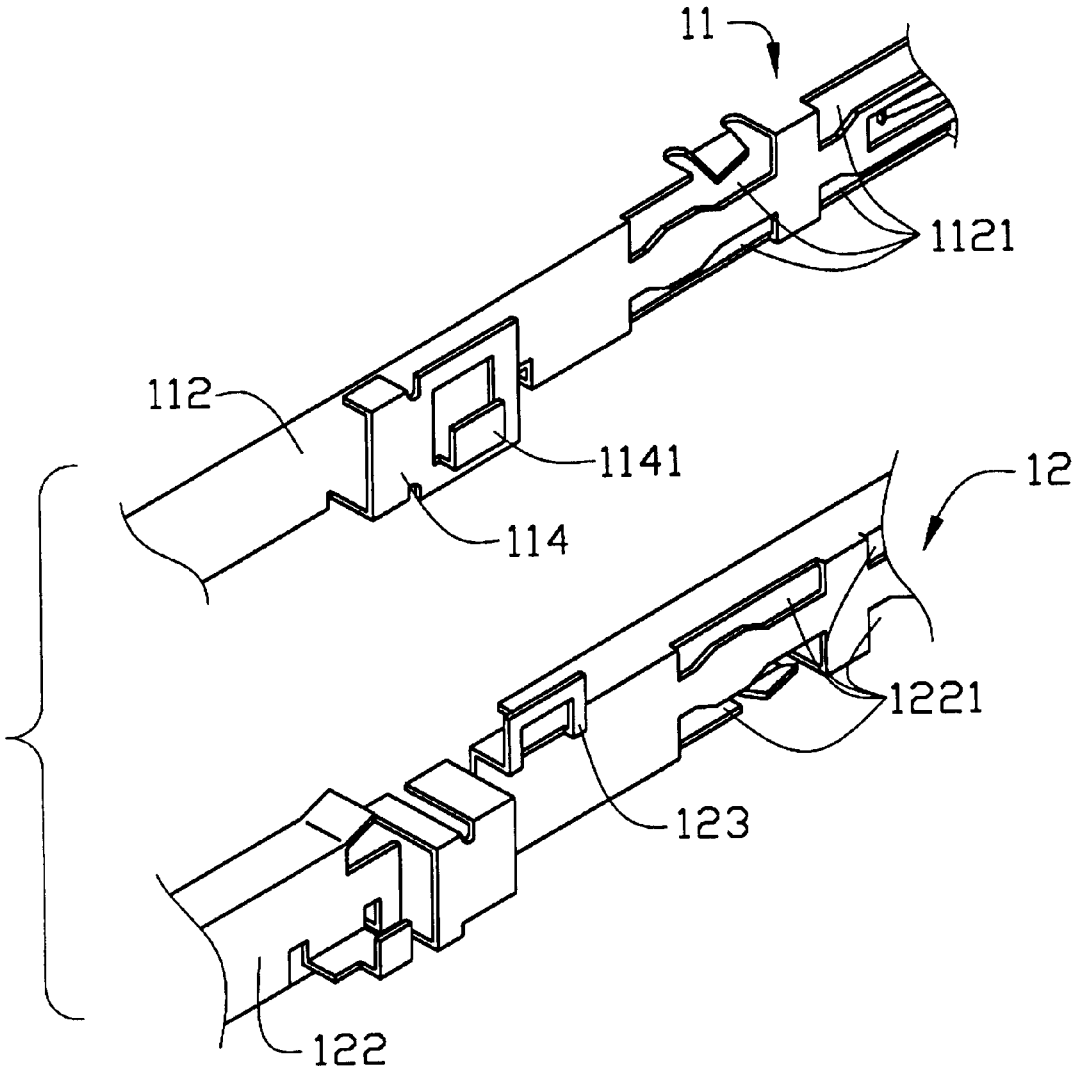
FIG. 4A is an enlarged, perspective view of a latch hook and a corresponding latch tab each formed on one side extension of an upper and a lower shield of the connector assembly, respectively.
Figure 4B:
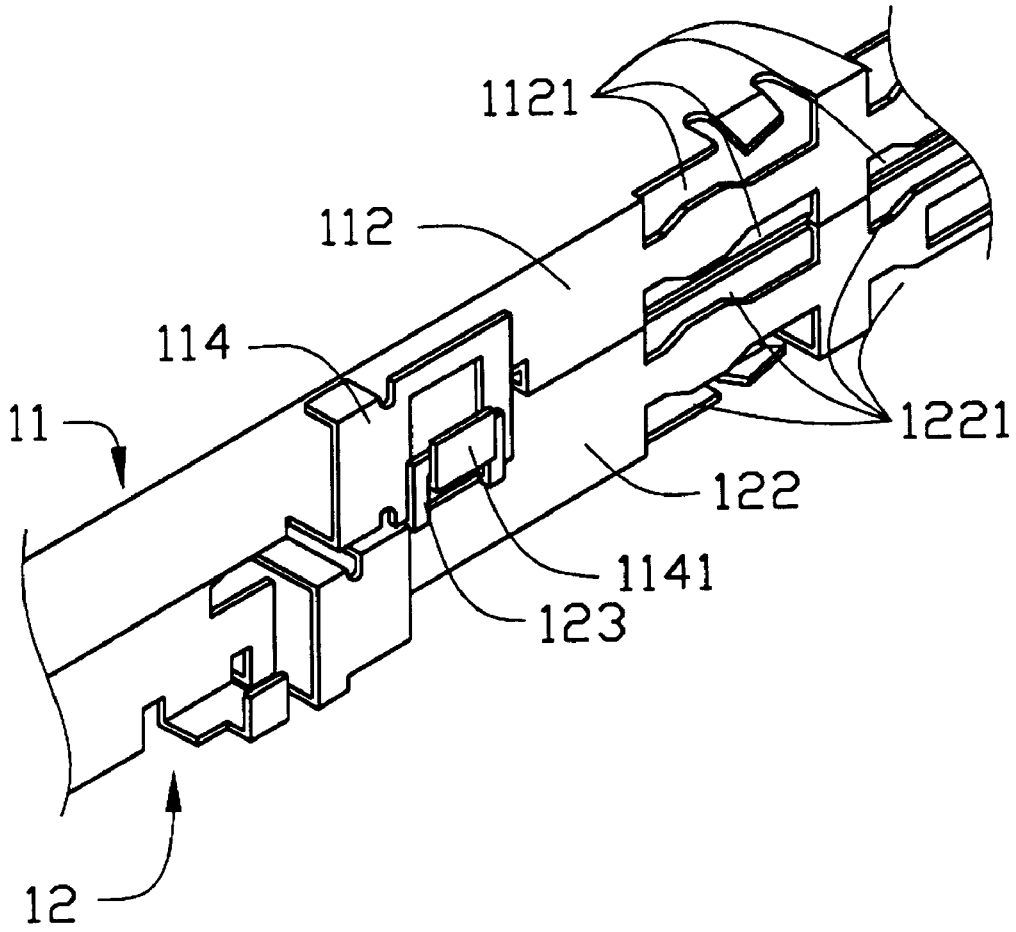
FIG. 4B is an assembled view of FIG. 4A showing the latch hook and the latch tab engaged with each other.

Referring to FIGS. 4A and 4B, the first engaging means on the side extension 112 of the upper shield 11 comprises a frame member 114 integrally formed parallel to the side extension 112. A latch hook 1141 outwardly extends from the frame member 114 and is bent upwards to be parallel to the frame member 114. The first mating means on the side extension 122 of the lower shield 12 comprises a perpendicularly bent latch tab 123 extending therefrom corresponding to the latch hook 1141 of the upper shield 11 for engaging therewith.

Figure 5A:
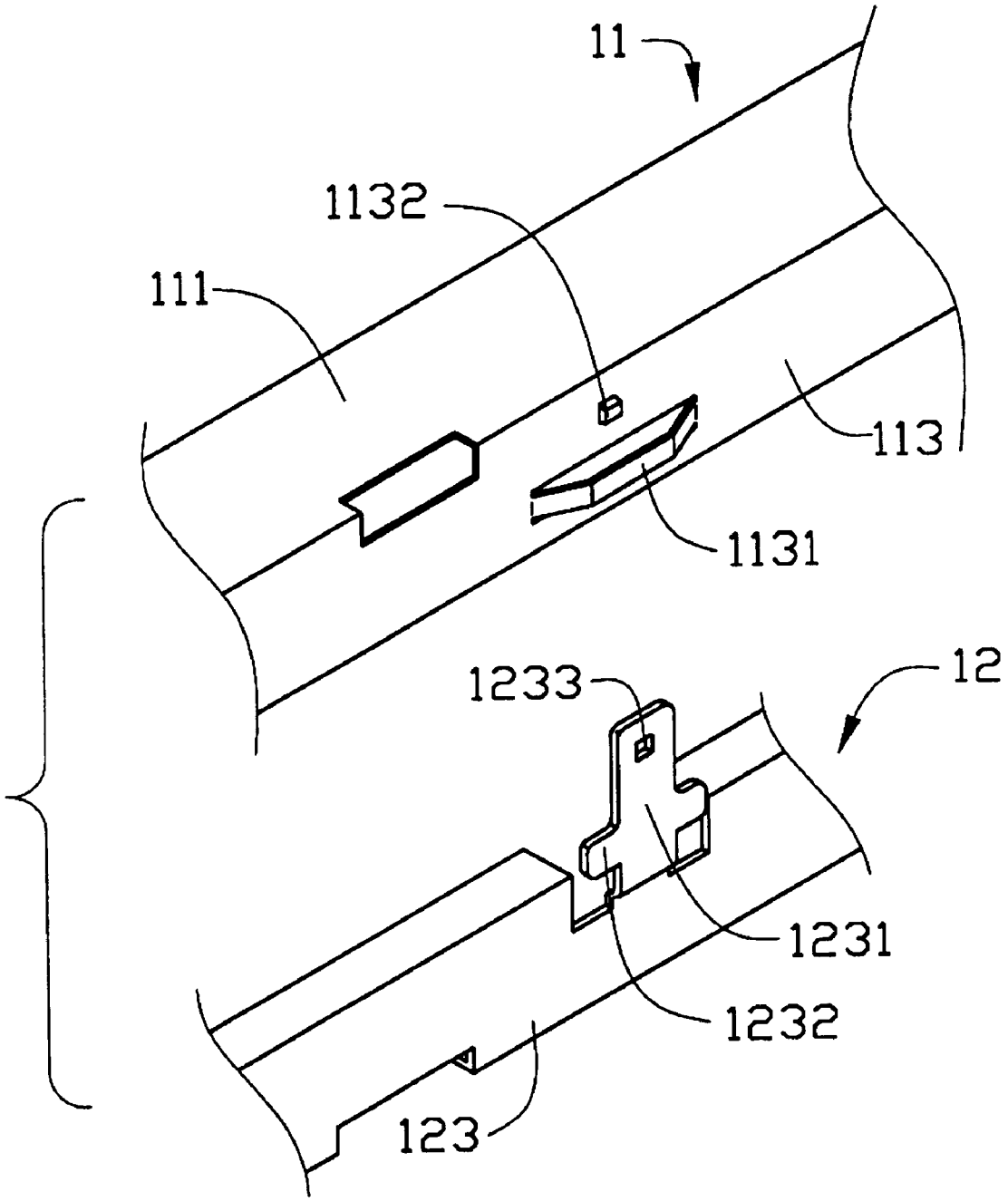
FIG. 5A is an enlarged, perspective view of a tenon and a tab formed on the other side extension of the upper shield, and a corresponding inserting piece formed on the other side extension of the lower shield.
Figure 5B:
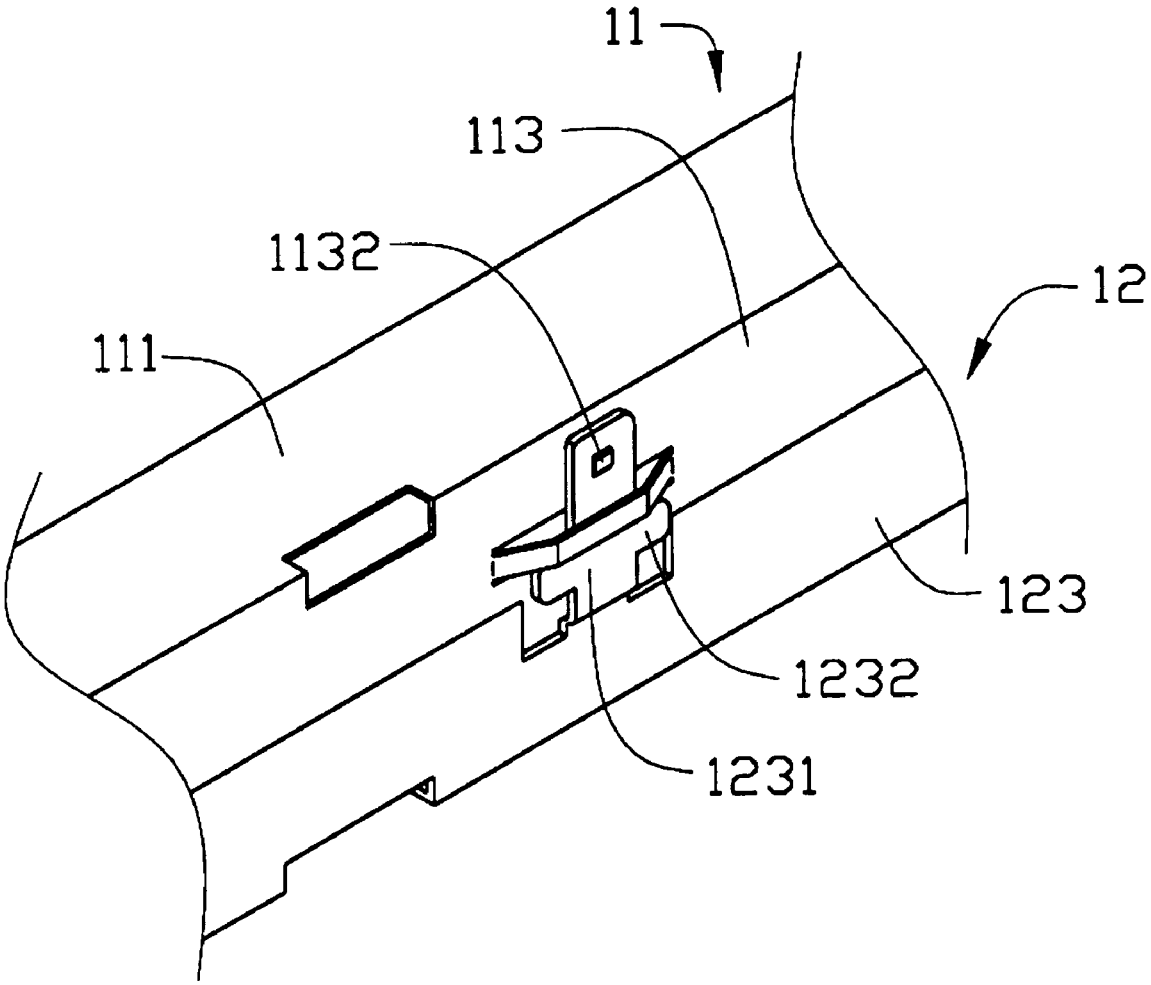
FIG. 5B is an assembled view of FIG. 5A showing the tenon and the inserting piece engaged with each other, an aperture in the inserting piece engaged with the tab, and a pair of stop portions of the inserting piece abutting against the tenon.

Referring to FIGS. 5A and 5B, the second engaging means on the side extension 113 of the upper shield 11 comprises a polygonal tenon 1131 integrally extending therefrom and a tab 1132 integrally formed thereon directly above the tenon 1131. The second mating means on the side extension 123 of the lower shield 12 comprises an inserting piece 1231 upwardly extending therefrom corresponding to the tenon 1131 and the tab 1132 of the upper shield 11. The inserting piece 1231 includes a pair of stop portions 1232 extending from opposite sides thereof for abutting against the tenon 1131 of the upper shield 11 and an aperture 1233 disposed therein for engaging with the tab 1132 of the upper shield 11. With this arrangement, the inserting piece 1231 is urged by the tenon 113 1 to be firmly secured to the side extension 113.

Referring back to FIG. 2, each shield 11, 12 further comprises two pairs of locking holes 1121, 1221 formed on an end portion of each side extension 112, 122 for mounting the ejection mechanism 3 thereto. A pair of locking pieces 115, 125 extends from front portions of each shield 11, 12. Each locking piece 115, 125 has an aperture (not labeled) disposed therein. A hook 1122, 1222 extends from the side extension 112, 122 of each shield 11, 12 proximate the locking piece 115, 125 for retaining the card ejection mechanism 3 and limiting vertical movement thereof.

Each header 2 comprises a plurality of passageways 21 for receiving a plurality of contacts 22 therein. A pair of screw holes 20 is disposed through opposite ends of the header 2 corresponding to the apertures of the locking pieces 115, 125 for the extension of bolts 4 therethrough to fasten the headers 2 and the shields 11, 12 together.

Each card ejection mechanism 3 comprises an actuator 31, an ejection plate 32, a guide 33 and a push rod 34, wherein the pivotable actuator 31 and the ejection plate 32 are secured together in a front portion of each shield 11, 12. The guide 33 comprises a pair of claws 331 extending therefrom for engaging with the corresponding locking holes 1121, 1221 thereby mounting the card ejection mechanism 3 to the shields 11, 12.

Figure 3:
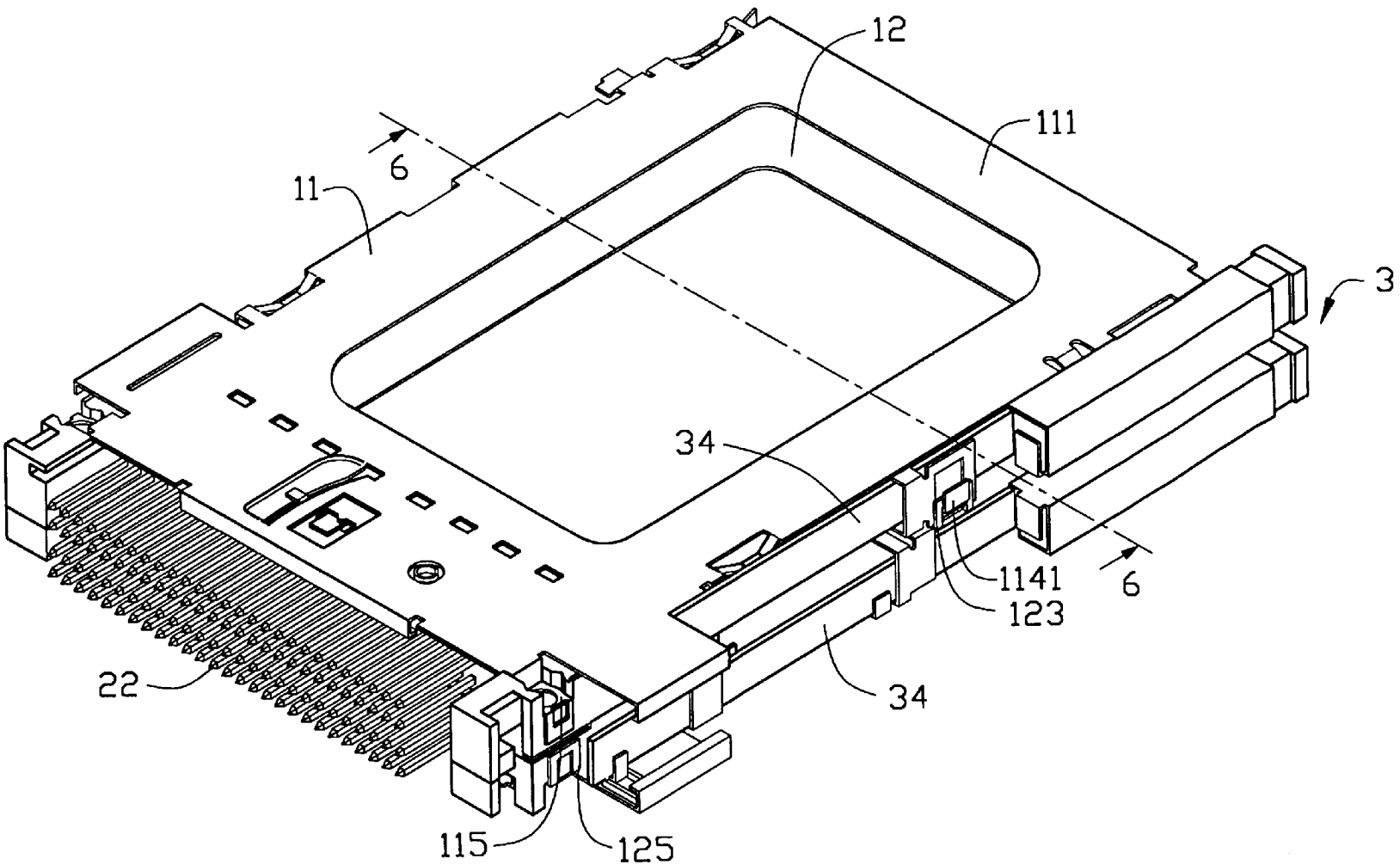
FIG. 3 is an assembled view of FIG. 2.

Referring to FIG. 3, in assembly, the two card ejection mechanisms 3 are mounted to the side extensions 112, 122 of the shields 11, 12. The two headers 2 are respectively positioned in the upper and lower shields 11, 12 with the locking pieces 115, 125 of the upper and lower shields 11, 12 aligned with the screw holes 20 of the headers 2.

Figure 6:
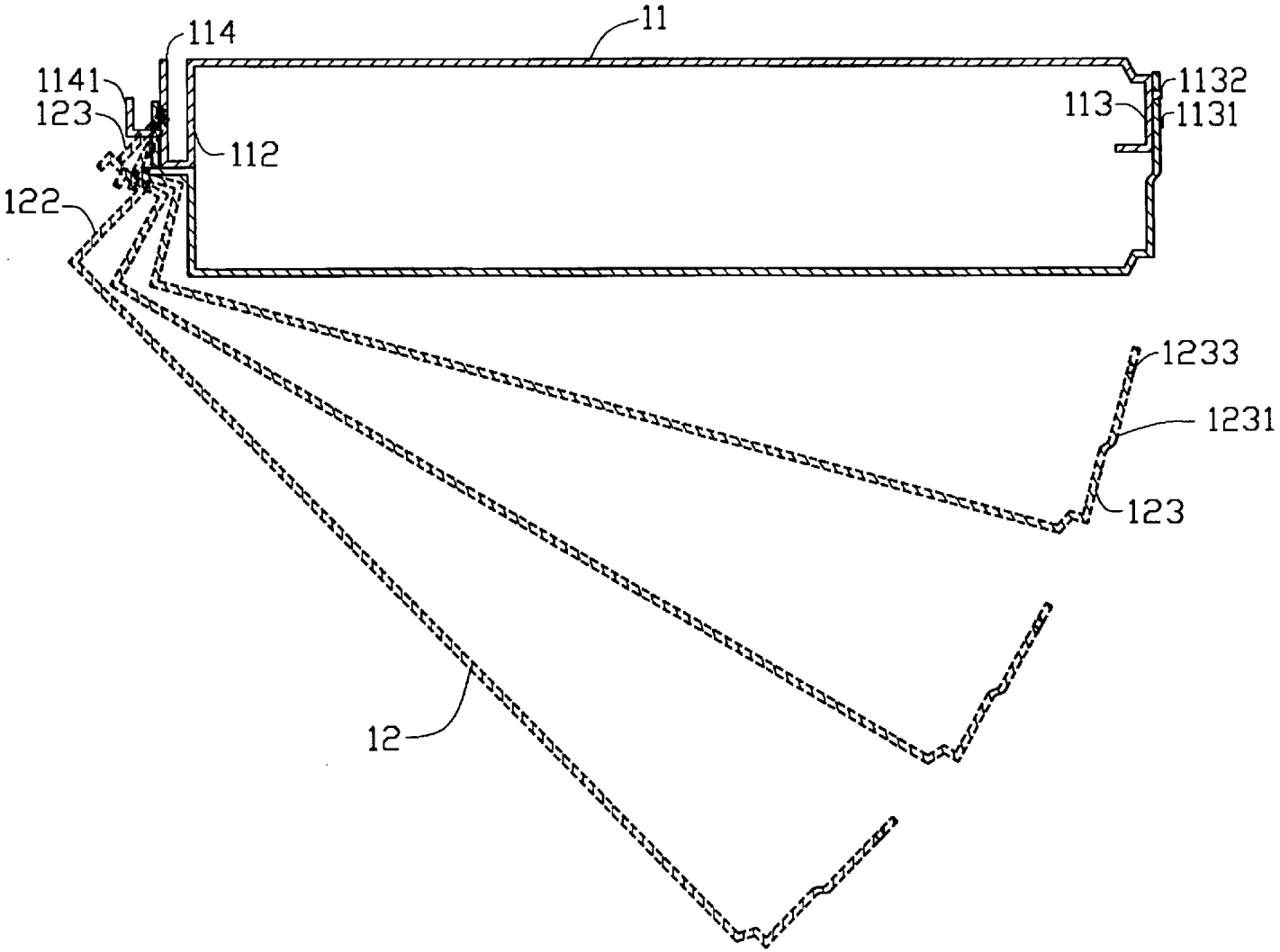
FIG. 6 is a cross-sectional view taken along line 6—6 of FIG. 3 showing the sequential assembly process of the upper and lower shields.

Referring also to FIG. 6, when engaging the upper shield 11 with the lower shield 12, the latch tab 123 on the side extension 122 of the lower shield 12 is hingedly engaged with the corresponding latch hook 1141 on the side extension 112 of the upper shield 11. The other side extension 123 of the lower shield 12 is then rotated toward the other side extension 113 of the upper shield 11. When the inserting piece 1231 is inserted into the tenon 1131 of the upper shield 11 and the stop portions 1232 abut against the bottom surface of the tenon 1131, the aperture 1233 of the inserting piece 1231 engages with the tab 1132 of the upper shield 11 thereby retentively attaching the shields 11, 12 together. The bolts 4 are sequentially extended through the apertures of the locking pieces 115 of the upper shield 11, the screw holes 20 of the two headers 2 and the apertures in the locking pieces 125 of the lower shield 12 for securing the headers 2 to the shields 11, 12 together with nuts 5.

In the preferred embodiment described above, the upper shield of the shielding comprises a first and second engaging means having different configurations, which is the same case for the lower shield. However, it would also be possible to construct the shields so that the upper shield comprises a tenon and a tab as engaging means on both of opposite side extensions thereof, and the lower shield comprises an corresponding inserting piece as mating means on both of opposite side extensions thereof. In such a case, the upper and lower shields are latchably engaged with each other without rotational movement therebetween.

It can be understood that in the invention the upper shield and the lower shield can first latched with each other without relative vertical movement thereof before the final assembling with the inner headers, thus avoiding the possible unstable and inconvenient assembling process as mentioned before.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked card connector assembly for receiving two electrical cards, comprising:

a shielding having an upper and a lower shields attached together, each shield comprising two opposite side extensions, first and second engaging means being respectively integrally formed on the two side extensions of the upper shield, and first and second mating means being respectively integrally formed on the two side extensions of the lower shield, the first engaging means being hingedly engagable with the first mating means to permit a rotational movement therebetween to effect an engagement of the second engaging means with the second mating means; and a pair of headers each attached to one of the upper and lower shields and having a plurality of passageways defined therein for receiving a plurality of contacts; wherein the first engaging means of the upper shield comprises a frame member integrally formed by upwardly bending a portion of one side extension in a direction parallel to the side extension, the frame member comprising a latch hook extending therefrom and upwardly bent in a direction parallel to the frame member; wherein the first mating means of the lower shield comprises a latch tab extending from one side extension of thelower shield and bent for engaging with the latch hook; wherein the second comprises means of the upper shied comprises a polygonal tenon integrally extending from the other side extension of the upper shield and a tab integrally formed directly above the tenon; wherein the second mating means of the lower shield comprises an inserting piece upwardly extending from the other side extension of the lower shield, the inserting piece Comprising a pair of stop portions extending from opposite sides thereof for abutting against the tenon of the upper shield and an aperture disposed therein for engaging with the tab of the upper shield.

2. The stacked card connector assembly according to claim 1, wherein the inserting piece of the lower shield engages with the corresponding tenon and tab of the upper shield.

* * * * *